US011302283B2

(12) United States Patent
Su et al.

(10) Patent No.: US 11,302,283 B2
(45) Date of Patent: Apr. 12, 2022

(54) SCREEN COLOR CONVERSION METHOD, STORAGE MEDIUM, AND ELECTRONIC DEVICE

(71) Applicant: BEIJING XIAOMI MOBILE SOFTWARE CO., LTD., Beijing (CN)

(72) Inventors: Xiaohuang Su, Beijing (CN); Dong Zhai, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 135 days.

(21) Appl. No.: 16/696,526

(22) Filed: Nov. 26, 2019

(65) Prior Publication Data

US 2020/0243042 A1 Jul. 30, 2020

(30) Foreign Application Priority Data

Jan. 30, 2019 (CN) ..... 201910094245.8

(51) Int. Cl.
*G09G 5/02* (2006.01)
*G09G 5/10* (2006.01)

(52) U.S. Cl.
CPC ..... *G09G 5/02* (2013.01); *G09G 5/10* (2013.01); *G09G 2320/0242* (2013.01); *G09G 2320/0247* (2013.01); *G09G 2320/0666* (2013.01)

(58) Field of Classification Search
None
See application file for complete search history.

(56) References Cited

U.S. PATENT DOCUMENTS 6,906,744 B1 * 6/2005 Hoshuyama ..... H04N 9/735 348/223.1
2004/0189630 A1 * 9/2004 Huh ..... G09G 5/00 345/418
2014/0333656 A1 11/2014 Wang
2014/0340434 A1 * 11/2014 El-Ghoroury ..... G09G 5/02 345/690
2015/0168723 A1 6/2015 Eto et al.
(Continued)

OTHER PUBLICATIONS

Partial European Search Report dated Jun. 29, 2020 in corresponding European Patent Application No. 19216048.9, 20 pages.

*Primary Examiner* — Aaron M Richer
(74) *Attorney, Agent, or Firm* — Oblon, McClelland, Maier & Neustadt, L.L.P.

(57) ABSTRACT

The present disclosure provides a screen color conversion method, a storage medium, and an electronic device. The method can include when an adjustment operation for a correlated color temperature of a color in a screen is triggered, determining target Red-Green-Blue (RGB) coefficients according to a relation curve between the RGB coefficients and a correlated color temperature, and a target correlated color temperature corresponding to the adjustment operation. The relation curve reflects a relation between a tristimulus value of a white color displayable for the screen and a correlated color temperature determined based on a black body radiation locus, and a target conversion matrix between the tristimulus value and the RGB coefficients. The method can further include converting the color in the screen to a target color corresponding to the target correlated color temperature according to the target RGB coefficient.

11 Claims, 4 Drawing Sheets

(56) References Cited

U.S. PATENT DOCUMENTS

| | | | | |
|---|---|---|---|---|
| 2016/0293139 | A1* | 10/2016 | Kwon | G06F 3/0482 |
| 2018/0137837 | A1 | 5/2018 | Peana et al. | |
| 2018/0308453 | A1 | 10/2018 | Li et al. | |
| 2020/0029061 | A1* | 1/2020 | Sarkar | H04N 7/147 |

* cited by examiner

SCREEN COLOR CONVERSION METHOD, STORAGE MEDIUM, AND ELECTRONIC DEVICE

CROSS-REFERENCE TO RELATED APPLICATION

The present application is based upon and claims priority to Chinese Patent Application No. 201910094245.8, filed on Jan. 30, 2019, the entire contents of which are incorporated herein by reference.

TECHNICAL FIELD

The present disclosure relates to the field of computer colorimetry, and more particularly, to a screen color conversion method, a storage medium, and an electronic device.

BACKGROUND

As the requirements for smart electronic devices in human's lives increase rapidly, users use electronic devices more frequently at night. However, when an electronic device is used at night, its screen tends to emit blue lights having a short wavelength in the spectrum with strong energy. Meanwhile, the cornea and the crystalline lens of human eyes cannot resist and refract blue lights, such that the blue lights directly reaching the retina of the fundus cause a series of chemical oxidation reactions of retinene. This can result in the production of toxic chemicals in non-renewable photoreceptor cells in the retinene, which seriously endangers the health of human eyes. In order to avoid the influence of the blue lights emitted by the screen on the eyes of the user at night, electronic devices are usually configured with a blue light control mode to reduce the blue lights emitted by the screen.

In the related art, the technology for reducing blue lights develops in aspects of software and hardware. In the hardware aspect, the blue light adjustment is usually achieved by adjusting the amplitude of the wavelength shift for the blue lights emitted by the screen to a long wavelength region by changing the material and position of the screen itself to filter out about 85% of the harmful blue lights and make the screen not appear orange, which results in high cost. In the software aspect, the blue light adjustment is usually achieved by adjusting color coordinates of all colors in the screen by changing the ratio of Red-Green-Blue (RGB) in the screen, thereby reducing the blue lights by about 30%. In the blue light control mode, the color of the screen is evenly divided into dozens of blue light control levels from the coldest correlated color temperature to the warmest correlated color temperature, and each blue light control level corresponds to RGB coefficients for adjusting the ratio of red, green and blue light in the screen, which is adjustable by the user. However, due to the sensitivity of the human eyes to white light, there is a brief jitter and flicker during adjustment.

SUMMARY

Embodiments of the present disclosure provide a screen color conversion method, a storage medium, and an electronic device. The screen color conversion method can include determining a target correlated color temperature corresponding to an adjustment operation for a correlated color temperature of a color in a screen, and determining target Red-Green-Blue (RGB) coefficients according to a relation curve and the target correlated color temperature. The relation curve reflects a relation between RGB coefficients and the correlated color temperature, and is determined according to a target correlation and a target conversion matrix. The target conversion matrix is a conversion matrix between a tristimulus value of a white color displayable for the screen and the RGB coefficients. The target correlation reflects a relation between the tristimulus value and the correlated color temperature determined according to a black body radiation locus. The method can further include converting the color in the screen to a target color corresponding to the target correlated color temperature according to the target RGB coefficients.

Embodiments of the present disclosure provide a computer readable storage medium having computer program instructions stored thereon, in which when the program instructions are executed by a processor. When executed, the instructions cause the processor to determine a target correlated color temperature corresponding to an adjustment operation for a correlated color temperature of a color in a screen, and determine target Red-Green-Blue (RGB) coefficients according to a relation curve and the target correlated color temperature. The relation curve reflects a relation between RGB coefficients and the correlated color temperature and is determined according to a target correlation and a target conversion matrix. The target conversion matrix is a conversion matrix between a tristimulus value of a white color displayable for the screen and the RGB coefficients. The target correlation reflects a relation between the tristimulus value and the correlated color temperature determined according to a black body radiation locus. The processor can further convert the color in the screen to a target color corresponding to the target correlated color temperature according to the target RGB coefficients.

Embodiments of the present disclosure provide an electronic device, including one or more processors and a memory storing instructions executable by the one or more processors. The one or more processors can be configured to determine a target correlated color temperature corresponding to an adjustment operation for a correlated color temperature of a color in a screen, and determine target Red-Green-Blue (RGB) coefficients according to a relation curve and the target correlated color temperature. The relation curve reflects a relation between RGB coefficients and the correlated color temperature and is determined according to a target correlation and a target conversion matrix. The target conversion matrix is a conversion matrix between a tristimulus value of a white color displayable for the screen and the RGB coefficients. The target correlation reflects a relation between the tristimulus value and the correlated color temperature determined according to a black body radiation locus. The one or more processors can also be configured to convert the color in the screen to a target color corresponding to the target correlated color temperature according to the target RGB coefficients.

It is to be understood that both the foregoing general description and the following detailed description are exemplary and explanatory only, and should not be considered as limitation of the present disclosure.

BRIEF DESCRIPTION OF THE DRAWINGS

The accompanying drawings, which are incorporated in and constitute a part of this specification, illustrate exemplary embodiments consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of apparatuses and methods consistent with aspects related to the present disclosure as recited in the appended claims.

Before introducing the screen color conversion method in the present disclosure, a target application scenario involved in various embodiments of the present disclosure is first introduced. The target application scenario includes a terminal, and the terminal includes a display device. The terminal is capable of displaying a variety of colors including white by the display device in a Red-Green-Blue (RGB) color space, with a blue light control mode switching function. The blue light control mode is a mode capable of controlling the blue lights emitted by the screen to protect human eyes. According to different application requirements and naming manners, the blue light control mode may be, for example, an eye protection mode, a night view mode, a night mode or a reading mode. The terminal may be, for example, a personal computer, a workstation, a notebook computer, a smart phone, a tablet computer, a smart TV, a smart watch, a Personal Digital Assistant (PDA), and the like.

Figure 1:
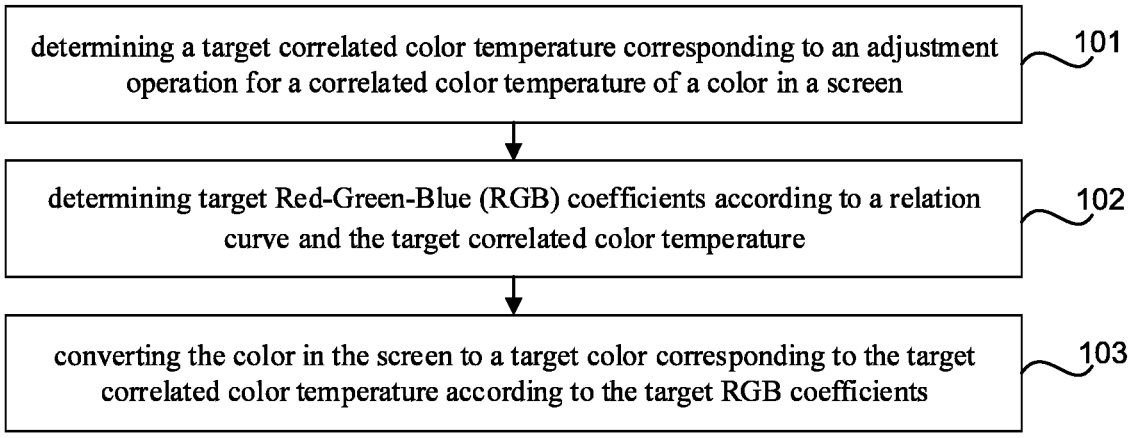
FIG. 1 illustrates a flowchart of a screen color conversion method according to an exemplary embodiment.

FIG. 1 illustrates a flowchart of a screen color conversion method according to an exemplary embodiment. As illustrated in FIG. 1, the method is applied to the terminal described in the above application scenario, and the method can includes the following.

At block 101, a target correlated color temperature corresponding to an adjustment operation for a correlated color temperature of a color in a screen is determined. For example, the adjustment operation is an operation for adjusting the correlated color temperature when a blue light control mode of the screen is turned on, or an operation for adjusting a blue light control level of a blue light control mode by adjusting the correlated color temperature in the blue light control mode. The blue light control mode includes a preset number of blue light control levels, and each blue light control level corresponds to one correlated color temperature.

The act in block 101 can include determining the correlated color temperature corresponding to each blue light control level between a current blue light control level of the screen and a target blue light control level set in the adjustment operation as the target correlated color temperature. The preset number corresponds to the number of the correlated color temperatures corresponding to the color points in the relation curve involved below. The target blue light control levels may be selected by the blue light control level selection button. Theoretically, there may be an infinite number of color points in the relation curve, and each color point corresponds to one correlated color temperature level, and the preset number may be an infinite number. However, in practical applications, it can be necessary to comprehensively consider the requirement of the color adjustment accuracy and the computing capacity of the terminal, such that the preset number may be set to a relatively large number (e.g., 800 or 1000).

At block 102, target Red-Green-Blue (RGB) coefficients are determined according to a relation curve and the target correlated color temperature. The relation curve reflects a relation between RGB coefficients and the correlated color temperature, and can be determined according to a target correlation and a target conversion matrix. The target conversion matrix is a conversion matrix between a tristimulus value of a white color displayable for the screen and the RGB coefficients. In the RGB color space, the tristimulus values of red, green, and blue are represented by R value, G value, and B value, respectively.

Since the three primary colors of red, green and blue selected from the actual spectrum are impossible to be mixed to represent all the colors that exist in nature, Commission Internationale de L'Eclairage (CIE) theoretically assumed in 1931 three theoretical primary colors which do not exist in nature and are represented by X, Y, and Z. These three theoretical primary colors form an XYZ color space and are proposed to theoretically represent all the colors in nature. All colors in the XYZ color space may be represented by the CIE 1931 chromaticity diagram. The stimulation amounts of these three theoretical primary colors, i.e., the above-mentioned three tristimulus values, are also represented by X, Y, Z. It should be noted that the white color displayable on the screen corresponds to all the white points in the chromaticity diagram raised by CIE in 1931.

In addition, the target correlation reflects a relation between the tristimulus value and the correlated color temperature (CCT) determined according to a black body radiation locus. Specifically, a black body (or an absolute black body) is an idealized object. This object is capable of absorbing all electric radiation from the outside and has a transmission coefficient of zero. As the temperature of the black body increases, its color will start to change from red to orange, yellow, white, and blue. That is, the dominant wavelength of its radiation spectrum gradually moves toward a blue region, which may be depicted in the above chromaticity diagram proposed by CIE in 1931 as the black body radiation locus. The color of the sun is the "ideal white" of all man-made illuminators, and the sun may be considered as a black body from some angles. Therefore, when the position of the corresponding color point of the white color of the screen in the chromaticity diagram changes as much as possible along the black body radiation locus (sunlight) from sunrise to sunset, the white color displayed on the screen is relatively natural.

At block 103, the color in the screen is converted to a target color corresponding to the target correlated color temperature according to the target RGB coefficients. For example, the target RGB coefficients includes an R value conversion coefficient, a G value conversion coefficient, and a B value conversion coefficient. The act at block 102 may include converting the R value, G value, and B value in RGB values corresponding to each of all colors currently displayed on the screen based on the target RGB coefficients to convert each color into a corresponding target color, in which the target color is a color corresponding to converted RGB values. It can be understood that the target RGB coefficients (actually stored and calculated in the form of a matrix) include the R value conversion coefficient, the G value conversion coefficient, and the B value conversion coefficient. New RGB values (i.e., the target RGB values) corresponding to each color may be obtained by multiplying the R value conversion coefficient, the G value conversion coefficient and the B value conversion coefficient by the R value, the G value, and the B value in the original RGB values of each color respectively. Each pixel point on the hardware of the screen outputs a target color corresponding to the target RGB values, thereby realizing the conversion of the screen color in the blue light control mode.

In addition, it can be understood that the specific value and button correspond to the correlated color temperature (or blue light control level) are not necessarily included in the blue light control mode interface that the user sees, and the user can set different blue light control levels by adjusting a slider bar, and observe the color of the screen simultaneously until the screen color is set as desired. Each change of the slider bar means that the user has entered a new target correlated color temperature. In the process of setting the correlated color temperature by the slider bar or the selection button, the execution of the color conversion between the adjacent two correlated color temperature (or blue light control level) bits is consistent (as illustrated in blocks 102 and 103). Taking the slider bar to set the correlated color temperature as an example, in the actual application process, the user can set the target correlated color temperature to any correlated color temperature of the preset number of correlated color temperatures corresponding to the relation curve.

The preset number corresponds to the number of blue light control levels in the above slider. Theoretically, there may be an infinite number of color points in the relation curve, and each color point corresponds to one correlated color temperature level, and the preset number may be an infinite number. However, in practical applications, it is necessary to comprehensively consider the requirement of the color adjustment accuracy and the computing capacity of the terminal, such that the preset number may be set to a relatively large number (e.g., 800 or 1000). For example, the leftmost of the slider bar of the blue light control mode of the terminal corresponds to a blue light control level A (actually the correlated color temperature of the color in the screen in the non-blue light control mode), and the rightmost of the slider bar corresponds to a blue light control level Z (actually the highest level of the correlated color temperature of the color in the screen in the blue light control mode).

During the process of the user dragging the slider bar from the blue light control level B to the blue light control level X, a plurality of blue light control levels, for example, 500 blue light control levels, are passed, in which the color conversion between every two blue light control levels is implemented through the above acts in blocks 101 and 102. Since the density of the blue light control levels between the blue light control level A and the blue light control level X is large, the transition effect from the blue light control level A to the blue light control level X is relatively smooth.

In conclusion, with the technical solution according to embodiments of the present disclosure, a target correlated color temperature corresponding to an adjustment operation for a correlated color temperature of a color in a screen is determined, target Red-Green-Blue (RGB) coefficients are determined according to a relation curve and the target correlated color temperature. The relation curve reflects a relation between RGB coefficients and the correlated color temperature and can be determined according to a target correlation and a target conversion matrix. The target conversion matrix is a conversion matrix between a tristimulus value of a white color displayable for the screen and the RGB coefficients. The target correlation reflects a relation between the tristimulus value and the correlated color temperature determined according to a black body radiation locus.

The color in the screen is converted to a target color corresponding to the target correlated color temperature according to the target RGB coefficients. The relation curve between the RGB coefficients and the correlated color temperature in the color adjustment is determined according to the black body radiation locus with the white color which is close to the natural white color of the sunlight as a standard for color adjustment, the number of color adjustment levels is increased, and the accuracy and smoothness of the color transition is improved to avoid screen flicker and jitter, thereby the user experience can also be improved.

Figure 2:
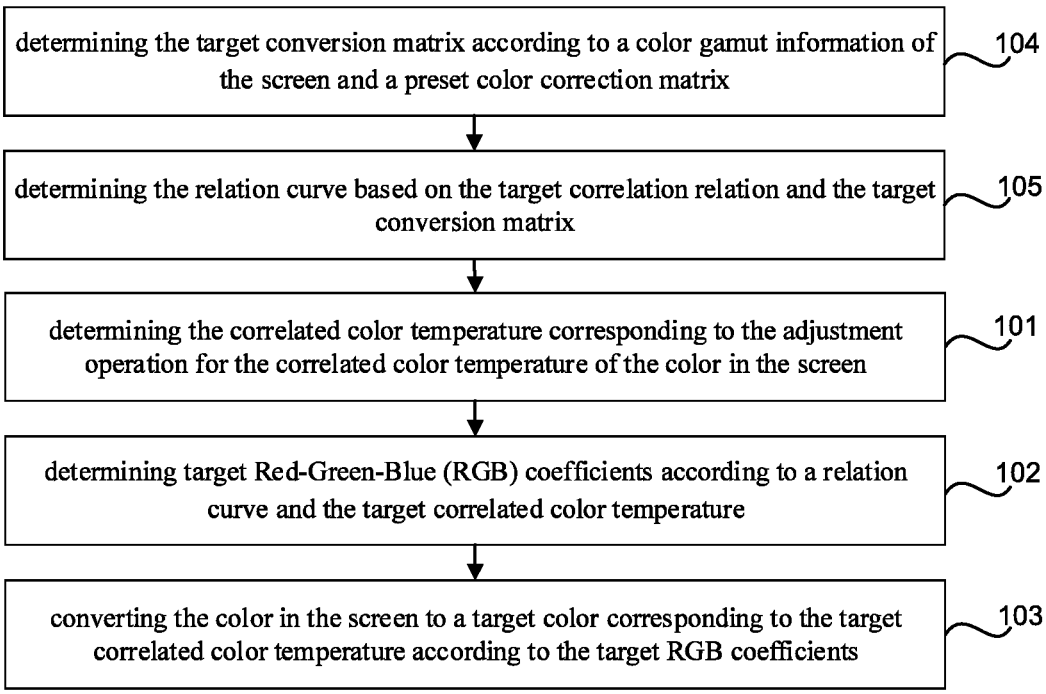
FIG. 2 illustrates a flowchart of another screen color conversion method according to FIG. 1.

FIG. 2 illustrates a flowchart of another screen color conversion method according to FIG. 1. As illustrated in FIG. 2, the above method also includes the following. At block 104, the target conversion matrix is determined according to a color gamut information of the screen and a preset color correction matrix. The preset color correction matrix is a color adaptation matrix preset according to a human eye color adaptation mechanism, and color distortion occurring at a time when a color conversion is performed between a white color displayable on the screen and colors except for the white color may be avoided.

For example, different brands and models of screens (display devices) correspond to different gamut information when different applications that require more accurate color output are used. In the above act in block 104, first, it is necessary to determine a color gamut information corresponding to the screen or the application, and determine a first conversion matrix between the tristimulus value of the white color displayable on the screen and the RGB coefficients according to the color gamut information, and then modify the first conversion matrix based on the color correction matrix to obtain the target conversion matrix.

In addition, before the process of rendering the entire display screen, it is necessary to determine the new RGB values for each pixel, the RGB values is the display data transmitted from the software end to the hardware end. Actually, the corresponding relation between the tristimulus value and the RGB coefficients are calculated in acts in block 104 and 105 in the embodiments of the present disclosure. When color conversion is performed on the display content, the RGB values corresponding to each pixel are multiplied by the RGB coefficients to calculate the new RGB values corresponding to each pixel, which are further transmitted to each of the physical pixel points to output color, in order to complete the color conversion in the blue light control mode.

At block 105, the relation curve is determined based on the target correlation and the target conversion matrix. For example, it should be noted that the acts in blocks 104 and 105 are the preliminary preparation process of the above acts in blocks 101-103, and the execution of the acts in blocks 104 and 105 is not initiated in response to the triggering of the adjustment operation, but is responsive to the change of the domain information. That is, the color gamut information changes when the screen color conversion method according to the embodiment of the present disclosure is applied to different brands and models of screens or different applications capable of more accurate color output. At this point, the acts in blocks 104 and 105 are triggered to determine the relation curve used to perform color conversion on the screen or the application.

Figure 3:
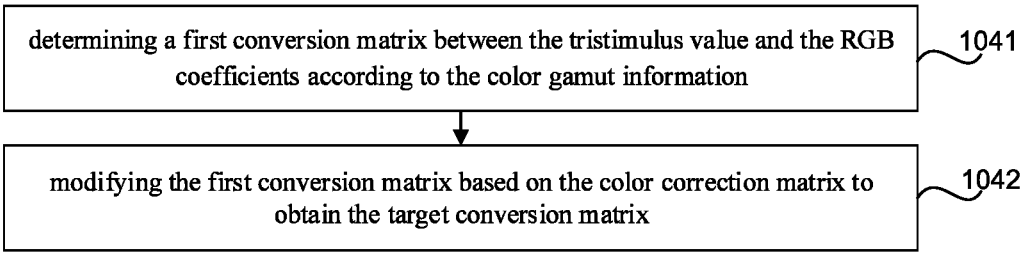
FIG. 3 illustrates a flowchart of a conversion matrix calculation method according to FIG. 2.

FIG. 3 illustrates a flowchart of a conversion matrix calculation method according to FIG. 2. As illustrated in FIG. 3, the act in block 104 can include the following. At block 1041, a first conversion matrix between the tristimulus value and the RGB coefficients are determined according to the color gamut information.

For example, the color gamut information may include: a color coordinate ($x_r$, $y_r$) of a standard red of the screen, a color coordinate ($x_g$, $y_g$) of a standard green of the screen, a color coordinate ($x_b$,$y_b$) of a standard blue of the screen, and a tristimulus value ($X_W$, $Y_W$, $Z_Q$) of a reference white of the screen. Specifically, the conversion process between the tristimulus value and the RGB coefficients may be expressed as the following formula (1):

$$\begin{bmatrix} X \\ Y \\ Z \end{bmatrix} [M]^{-1} = \begin{bmatrix} R \\ G \\ B \end{bmatrix}, \tag{1}$$

where [M] is the conversion matrix from the RGB color space to the XYZ color space, the inverse matrix is the first conversion matrix described above, and specifically, the conversion matrix [M] may be expressed as the following formula (2):

$$[M] = \begin{bmatrix} S_rX_r & S_gX_g & S_bX_b \\ S_rY_r & S_gY_g & S_bY_b \\ S_rZ_r & S_gZ_g & S_bZ_b \end{bmatrix}, \tag{2}$$

where the values of $Y_r$, $Y_g$ and $Y_b$ are 1, the value of $X_r$, $X_g$, $X_b$, $Z_r$, $Z_g$ and $Z_b$ are calculated based on the values of $Y_r$, $Y_g$ and $Y_b$, and the coordinate values of color coordinates ($x_r$,$y_r$) ($x_g$,$y_g$) and ($x_b$,$y_b$), and the coefficients $S_r$, $S_g$ and $S_b$ are calculated by the following formula (3):

$$\begin{bmatrix} S_r \\ S_g \\ S_b \end{bmatrix} = \begin{bmatrix} X_r & X_g & X_b \\ Y_r & Y_g & Y_b \\ Z_r & Z_g & Z_b \end{bmatrix}^{-1} \begin{bmatrix} X_W \\ Y_W \\ Z_W \end{bmatrix}. \tag{3}$$

At block 1042, the first conversion matrix is modified based on the color correction matrix to obtain the target conversion matrix. The color correction matrix is a color adaptation matrix preset according to a human eye color adaptation mechanism, and avoiding color distortion when a color conversion is performed between a white color displayable on the screen and colors except for the white color. In the process of performing color conversion by the screen color conversion method according to the embodiments of the present disclosure, when the target correlated color temperature input by the user matches the ambient color temperature, the white color displayed on the screen is more natural, but distortion occurs in non-neutral colors (colors except for the white color). In fact, based on the color appearance of the human eyes, two colors having the same tristimulus value may appear differently under different lighting conditions. The root cause of the above-mentioned color appearance phenomenon is the color adaptation mechanism of the human eyes, that is, the ability of the human eye vision system to maintain the color appearance of the object even if the color of the illumination source changes. In order to compensate the human eyes color adaptation mechanism, in embodiments of the present disclosure, an appropriate color adaptation matrix is pre-selected as a color correction matrix according to the application scenario and the color display requirement, and the displayed non-neutral colors are modified, such that the non-neutral colors changes as the correlated color temperature on the screen changes and as the white color changes. The color appearance uniformity is maintained under the action of the human eye color adaptation mechanism to avoid distortion of non-neutral colors.

Figure 4:
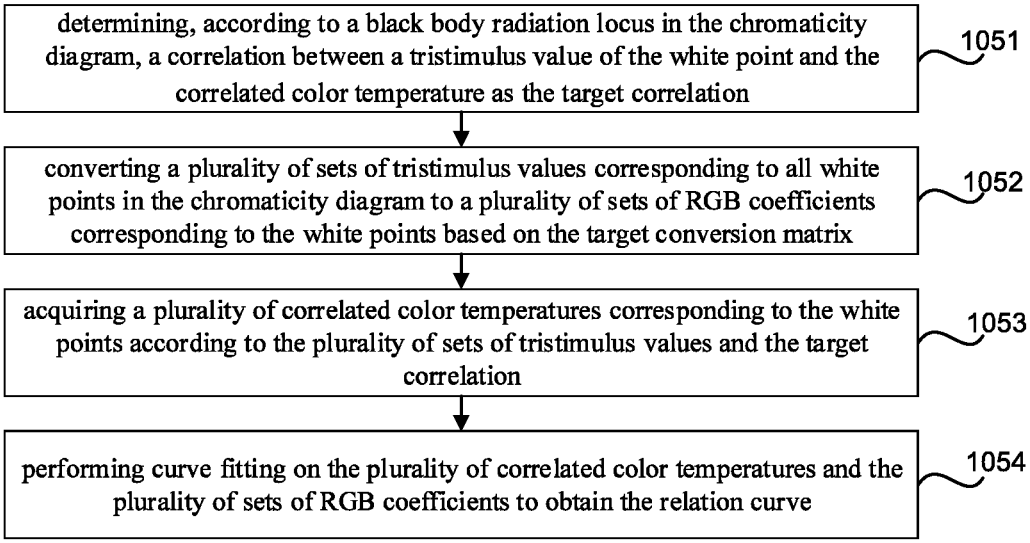
FIG. 4 illustrates a flowchart of a method for determining a relation curve according to FIG. 2.

FIG. 4 illustrates a flowchart of a method for determining a relation curve according to FIG. 2. As illustrated in FIG. 4, the white color displayable by the screen corresponds to a white point in a chromaticity diagram, the act in block 105 also can include the following. At block 1051, a correlation between a tristimulus value of the white point and the correlated color temperature is determined according to a black body radiation locus in the chromaticity diagram as the target correlation.

For example, the chromaticity diagram is the CIE 1931 chromaticity diagram described above. At block 1021, it is first necessary to convert the color coordinate of each white point in the chromaticity diagram to a tristimulus value. For example, if the color coordinate of any color point in the chromaticity diagram is known as (x, y), the conversion relation between the coordinate values x, y in the color coordinate and the X value, the Y value, and the Z value is: $x=X/(X+Y+Z)$, $y=Y/(X+Y+Z)$, $1-x-y=Z/(X+Y+Z)$. In the case that x and y are known, the tristimulus value corresponding to the color coordinate may be calculated. In the chromaticity diagram, the color point coincident with the black body radiation locus corresponds to the color temperature, and the color point within a certain distance around the black body radiation locus corresponds to the correlated color temperature. It should be noted that since the black body radiation locus is determined based on the color coordinate and color temperature of the color of the sunlight, the display screen in reality is almost impossible to achieve the color effect of the sunlight, and therefore, it can be considered that the white color displayable on the screen only corresponds to the correlated color temperature. Based on this, after acquiring the color coordinates of the white point, the correlated color temperature corresponding to the white point can be found in the CIE 1931 chromaticity diagram described above. Further, the color coordinate of the white point can be converted into a tristimulus value, and then the correlation equations of the tristimulus value along with the changes of the correlated color temperature are $X=f_1(CCT)$, $Y=f_2(CCT)$ and $Z=f_3(CCT)$, i.e., the above target correlation.

At block 1052, a plurality of sets of tristimulus values corresponding to all white points in the chromaticity diagram are converted to a plurality of sets of RGB coefficients corresponding to the white points based on the target conversion matrix.

At block 1053, a plurality of correlated color temperatures corresponding to the white points are acquired according to the plurality of sets of tristimulus values and the target correlation.

At block 1054, curve fitting is performed on the plurality of correlated color temperatures and the plurality of sets of RGB coefficients to obtain the relation curve. For example, it is known that the screen can display 100 kinds of white, then it can be determined that these whites correspond to 100 white points in the chromaticity diagram (i.e., all the white points mentioned above), and the 100 sets of white points correspond to 100 sets of tristimulus value, the 100 correlated color temperatures corresponding to the 100 sets of tristimulus values can be determined by the target correlation described above. Thereafter, the 100 sets of tristimulus values can be converted into 100 sets of RGB coefficients by the target conversion matrix described above. In this way, it is possible to determine 100 correlated color temperatures corresponding to 100 sets of RGB coefficients. Then, the 100 sets of RGB coefficients and 100 correlated color temperatures are fitted by a preset curve type (for example, a root equation of a degree, a root equation of two degree, a simple cubic equation, and an exponential function) as relation curve equation $R=f_4$ (CCT), $G=f_5$ (CCT) and $B=f_6$(CCT) that reflect the correspondence.

In conclusion, with the technical solution according to embodiments of the present disclosure, a target correlated color temperature corresponding to an adjustment operation for a correlated color temperature of a color in a screen is determined, target Red-Green-Blue (RGB) coefficients is determined according to a relation curve and the target correlated color temperature, in which the relation curve reflects a relation between RGB coefficients and the correlated color temperature and is determined according to a target correlation and a target conversion matrix, the target conversion matrix is a conversion matrix between a tristimulus value of a white color displayable for the screen and the RGB coefficients, and the target correlation reflects a relation between the tristimulus value and the correlated color temperature determined according to a black body radiation locus. The color in the screen is converted to a target color corresponding to the target correlated color temperature according to the target RGB coefficients. The relation curve between the RGB coefficients and the correlated color temperature in the color adjustment is determined according to the black body radiation locus with the white color which is close to the natural white color of the sunlight as a standard for color adjustment, the number of color adjustment levels is increased, and the accuracy and smoothness of the color transition is improved to avoid screen flicker and jitter, thereby the user experience is improved.

Figure 5:
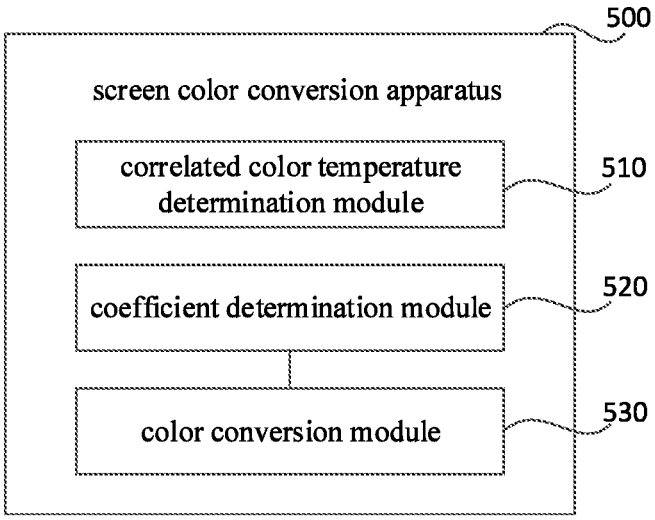
FIG. 5 illustrates a block diagram of a screen color conversion apparatus according to an exemplary embodiment.

FIG. 5 illustrates a block diagram of a screen color conversion apparatus according to an exemplary embodiment. As illustrated in FIG. 5, the apparatus may be applied to the terminal in the above application scenario. The apparatus 500 can include a correlated color temperature determination module 510, a coefficient determination module 520, and a color conversion module 530.

The correlated color temperature determination module 510 is configured to determine a target correlated color temperature corresponding to an adjustment operation for a correlated color temperature of a color in a screen.

The coefficient determination module 520 is configured to determine target Red-Green-Blue (RGB) coefficients according to a relation curve and the target correlated color temperature. The relation curve reflects a relation between RGB coefficients and the correlated color temperature and is determined according to a target correlation and a target conversion matrix. The target conversion matrix is a conversion matrix between a tristimulus value of a white color displayable for the screen and the RGB coefficients. The target correlation reflects a relation between the tristimulus value and the correlated color temperature determined according to a black body radiation locus.

The color conversion module 530 is configured to convert the color in the screen to a target color corresponding to the target correlated color temperature according to the target RGB coefficients.

Figure 6:
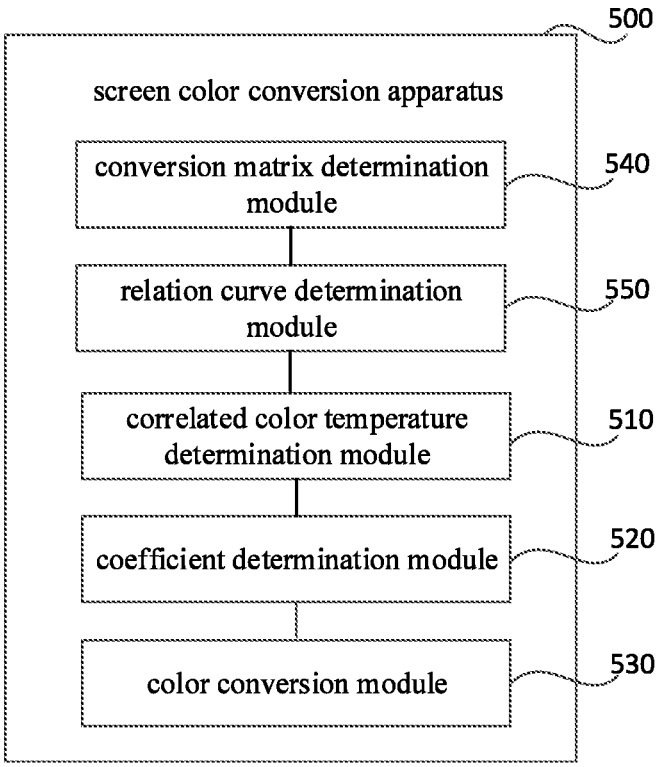
FIG. 6 illustrates a block diagram of another screen color conversion apparatus according to FIG. 5.

FIG. 6 illustrates a block diagram of another screen color conversion apparatus according to FIG. 5. As illustrated in FIG. 6, the apparatus 500 can also include a conversion matrix determination module 540 and a relation curve determination module 550.

The conversion matrix determination module 540 is configured to determine the target conversion matrix according to a color gamut information of the screen and a preset color correction matrix. The preset color correction matrix is a color adaptation matrix preset according to a human eye color adaptation mechanism, and avoiding color distortion when a color conversion is performed between a white color displayable on the screen and colors except for the white color.

The relation curve determination module 550 is configured to determine the relation curve based on the target correlation and the target conversion matrix.

Figure 7:
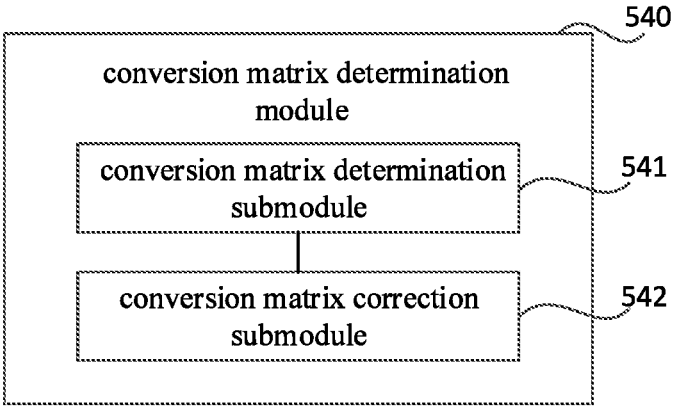
FIG. 7 illustrates a block diagram of a conversion matrix determination module according to FIG. 6.

FIG. 7 illustrates a block diagram of a conversion matrix determination module according to FIG. 6. As illustrated in FIG. 7, the conversion matrix determination module 540 can also include a conversion matrix determination submodule 541 and a conversion matrix correction submodule 542.

The conversion matrix determination submodule 541 is configured to determine a first conversion matrix of the tristimulus value and the RGB coefficients according to the color gamut information, in which the color gamut information comprises a color coordinate of a standard red of the screen, a color coordinate of a standard green of the screen, a color coordinate of a standard blue of the screen, and a tristimulus value of a reference white of the screen.

The conversion matrix correction submodule 542 is configured to modify the first conversion matrix based on the color correction matrix to obtain the target conversion matrix, in which the preset color correction matrix is a color adaptation matrix preset according to a human eye color adaptation mechanism, and avoiding color distortion when a color conversion is performed between a white color displayable on the screen and colors except for the white color.

Figure 8:
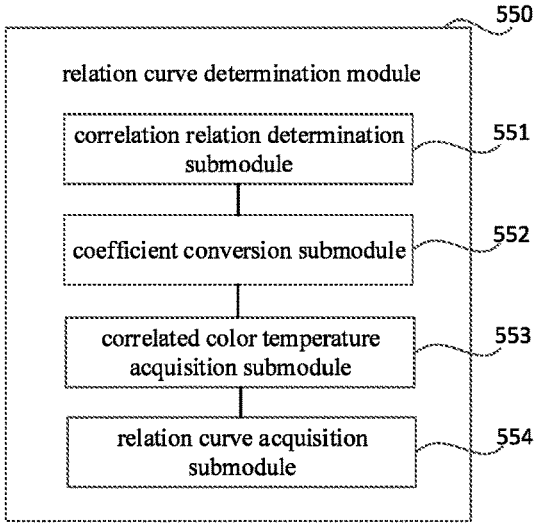
FIG. 8 illustrates a block diagram of a relation curve module according to FIG. 6.

FIG. 8 illustrates a block diagram of a relation curve module according to FIG. 6. As illustrated in FIG. 8, the white color displayable on the screen corresponds to a white point in the chromaticity diagram, and the relation curve determination module 550 can include a correlation determination submodule 551, a coefficient conversion submodule 552, a correlated color temperature acquisition submodule 553, and a relation curve acquisition submodule 554.

The correlation determination submodule 551 is configured to determine, according to a black body radiation locus in the chromaticity diagram, a correlation between a tristimulus value of the white point and the correlated color temperature as the target correlation.

The coefficient conversion submodule 552 is configured to convert a plurality of sets of tristimulus values corresponding to all white points in the chromaticity diagram to a plurality of sets of RGB coefficients corresponding to the white points based on the target conversion matrix.

The correlated color temperature acquisition submodule 553 is configured to acquire a plurality of correlated color temperatures corresponding to the white points according to the plurality of sets of tristimulus values and the target correlation.

The relation curve acquisition submodule 554 is configured to perform curve fitting on the plurality of correlated color temperatures and the plurality of sets of RGB coefficients to obtain the relation curve.

Optionally, the target RGB coefficients include an R value conversion coefficient, a G value conversion coefficient, and a B value conversion coefficient, and the color conversion module 530 is configured to convert the R value, G value, and B value in RGB values corresponding to each of all colors currently displayed on the screen based on the target RGB coefficients to convert each color into a corresponding target color. The target color is a color corresponding to converted RGB values.

In conclusion, with the technical solution according to embodiments of the present disclosure, a target correlated color temperature corresponding to an adjustment operation for a correlated color temperature of a color in a screen is determined, target Red-Green-Blue (RGB) coefficients is determined according to a relation curve and the target correlated color temperature, in which the relation curve reflects a relation between RGB coefficients and the correlated color temperature and is determined according to a target correlation and a target conversion matrix, the target conversion matrix is a conversion matrix between a tristimulus value of a white color displayable for the screen and the RGB coefficients, and the target correlation reflects a relation between the tristimulus value and the correlated color temperature determined according to a black body radiation locus. The color in the screen is converted to a target color corresponding to the target correlated color temperature according to the target RGB coefficients. The relation curve between the RGB coefficients and the correlated color temperature in the color adjustment is determined according to the black body radiation locus with the white color which is close to the natural white color of the sunlight as a standard for color adjustment, the number of color adjustment levels is increased, and the accuracy and smoothness of the color transition is improved to avoid screen flicker and jitter, thereby the user experience can be improved.

Figure 9:
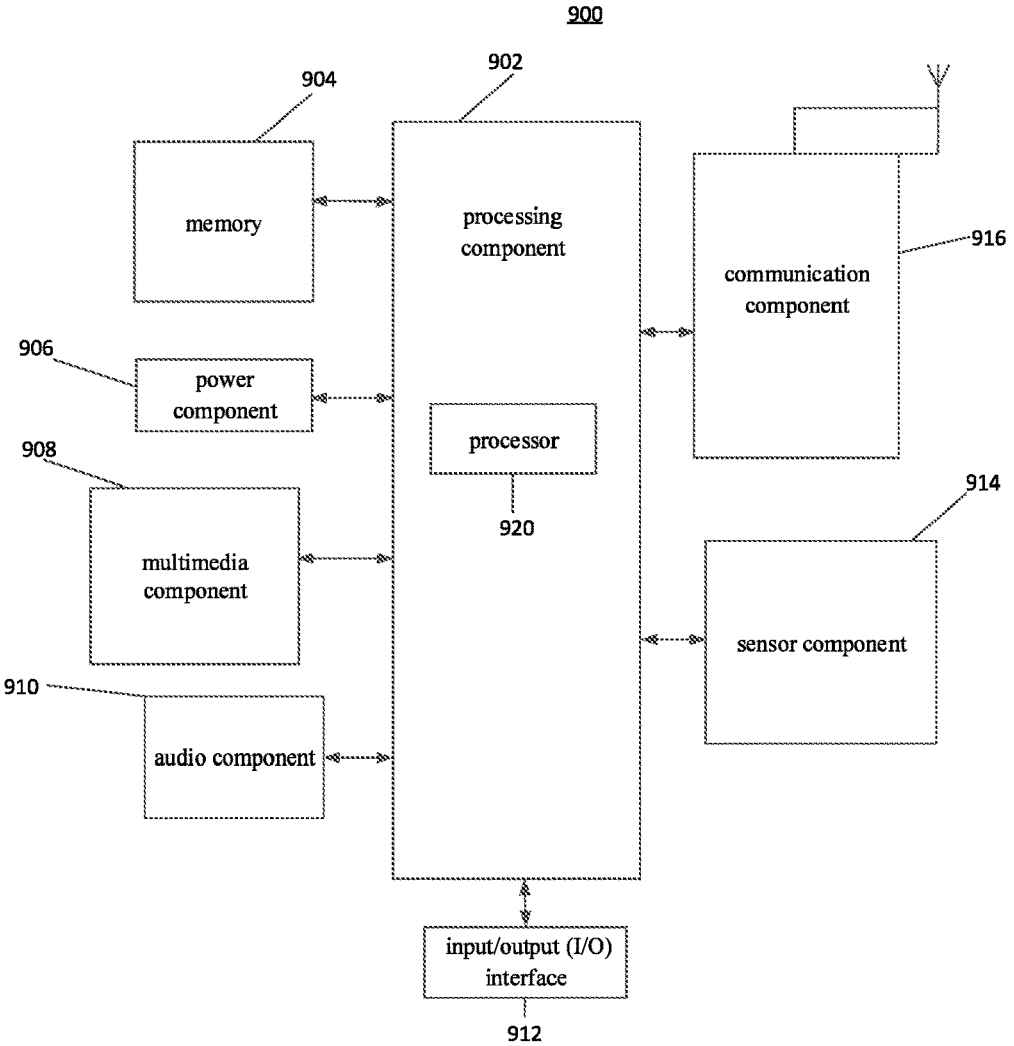
FIG. 9 illustrates a block diagram of an electronic device according to an exemplary embodiment.

FIG. 9 illustrates a block diagram of an electronic device, according to an exemplary embodiment. An electronic device 900 is used to perform the screen color conversion method shown in FIGS. 1 to 4 above. Referring to FIG. 9, the electronic device 900 may include one or more of the following components: a processing component 902, a memory 904, a power component 906, a multimedia component 908, an audio component 910, an input/output (I/O) interface 912, a sensor component 914, and a communication component 916.

The processing component 902 typically controls overall operations of the device 900, such as the operations associated with display, telephone calls, data communications, camera operations, and recording operations. The processing component 902 may include one or more processors 920 to execute instructions to perform all or part of the steps in the above described methods. Moreover, the processing component 902 may include one or more modules which facilitate the interaction between the processing component 902 and other components. For instance, the processing component 902 may include a multimedia module to facilitate the interaction between the multimedia component 908 and the processing component 902.

The memory 904 is configured to store various types of data to support the operation of the device 900. Examples of such data include instructions for any applications or methods operated on the device 900, contact data, phonebook data, messages, pictures, video, etc. The memory 804 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 906 provides power to various components of the device 900. The power component 906 may include a power management system, one or more power sources, and any other components associated with the generation, management, and distribution of power in the device 900.

The multimedia component 908 includes a screen providing an output interface between the device 900 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 908 includes a front camera and/or a rear camera. When the device 900 is in an operation mode, such as a shooting mode or a video mode, the front camera and/or the rear camera can receive external multimedia data. Each front or rear camera can be a fixed optical lens system or have focal length and optical zoom capabilities.

The audio component 910 is configured to output and/or input audio signals. For example, the audio component 910 includes a microphone ("MIC") configured to receive an external audio signal when the device 900 is in an operation mode, such as a call mode, a recording mode, and a voice recognition mode. The received audio signal may be further stored in the memory 904 or transmitted via the communication component 916. In some embodiments, the audio component 910 further includes a speaker to output audio signals.

The I/O interface 912 provides an interface between the processing component 902 and peripheral interface modules, such as a keyboard, a click wheel, buttons, and the like. The buttons may include, but are not limited to, a home button, a volume button, a starting button, and a locking button.

The sensor component 914 includes one or more sensors to provide status assessments of various aspects of the device 900. For instance, the sensor component 914 may detect an open/closed status of the device 900, relative positioning of components, e.g., the display and the keypad, of the device 800, a change in position of the device 900 or a component of the device 900, a presence or absence of user contact with the device 900, an orientation or an acceleration/deceleration of the device 900, and a change in temperature of the device 900. The sensor component 914 may include a proximity sensor configured to detect the presence of nearby objects without any physical contact. The sensor component 914 may also include a light sensor, such as a CMOS or CCD image sensor, for use in imaging applications. In some embodiments, the sensor component 914 may also include an accelerometer sensor, a gyroscope sensor, a magnetic sensor, a pressure sensor, or a temperature sensor.

The communication component 916 is configured to facilitate communication, wired or wirelessly, between the device 900 and other devices. The device 900 can access a wireless network based on a communication standard, such as WiFi, 2G, or 3G, or a combination thereof. In one exemplary embodiment, the communication component 916 receives a broadcast signal or broadcast associated information from an external broadcast management system via a broadcast channel. In one exemplary embodiment, the communication component 916 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the device 900 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In exemplary embodiments, there is also provided a non-transitory computer readable storage medium including instructions, such as included in the memory 904, executable by the processor 920 in the device 900, for performing the above-described methods. For example, the non-transitory computer-readable storage medium may be a ROM, a RAM, a CD-ROM, a magnetic tape, a floppy disc, an optical data storage device, and the like. This disclosure can reduce the dependence on the signal strength of the WLAN device when positioning the location of the WLAN device, so that the error precision of positioning can be controlled, and the accuracy of positioning is improved.

Other embodiments of the present disclosure will be apparent to those skilled in the art from consideration of the specification and practice of the present disclosure disclosed here. This application is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the present disclosure only be limited by the appended claims.

What is claimed is:

1. A screen color conversion method, comprising:

determining a target correlated color temperature corresponding to an adjustment operation for a correlated color temperature of a color in a screen;

determining a relation curve reflecting a relation between RGB coefficients and the correlated color temperature according to a target correlation and a target conversion matrix, wherein the target conversion matrix is a conversion matrix between a tristimulus value of a white color displayable for the screen and the RGB coefficients, and the target correlation reflects a relation between the tristimulus value and the correlated color temperature determined according to a black body radiation locus;

determining target Red-Green-Blue (RGB) coefficients according to the relation curve and the target correlated color temperature; and converting the color in the screen to a target color corresponding to the target correlated color temperature according to the target RGB coefficients, wherein before determining the target correlated color temperature corresponding to the adjustment operation for the correlated color temperature of the color in the screen, the method further comprises:

determining the target conversion matrix according to a color gamut information of the screen and a preset color correction matrix, where the preset color correction matrix is a color adaptation matrix preset according to a human eye color adaptation mechanism, and avoiding color distortion when a color conversion is performed between a white color displayable on the screen and colors except for the white color; and determining the relation curve based on the target correlation and the target conversion matrix, wherein determining the target conversion matrix according to the color gamut information of the screen and the preset color correction matrix further comprises:

determining a first conversion matrix between the tristimulus value and the RGB coefficients according to the color gamut information, where the color gamut information includes a color coordinate of a standard red of the screen, a color coordinate of a standard green of the screen, a color coordinate of a standard blue of the screen, and a tristimulus value of a reference white of the screen; and modifying the first conversion matrix based on the color correction matrix to obtain the target conversion matrix.

2. The method according to claim 1, wherein the adjustment operation further comprises an operation of adjusting at least one of:

the correlated color temperature when a blue light control mode of the screen is turned on, and a blue light control level of the blue light control mode by adjusting the correlated color temperature in the blue light control mode.

3. The method according to claim 2, wherein:

the blue light control mode further includes a preset number of blue light control levels, each blue light control level corresponding to one correlated color temperature, and determining the correlated color temperature corresponding to the adjustment operation for the correlated color temperature of the color in the screen further includes determining the correlated color temperature corresponding to each blue light control level between a current blue light control level of the screen and a target blue light control level set in the adjustment operation as the target correlated color temperature.

4. The method according to claim 1, wherein the white color displayable by the screen corresponds to a white point in a chromaticity diagram, and determining the relation curve based on the target correlation and the target conversion matrix further comprises:

determining, according to a black body radiation locus in the chromaticity diagram, a correlation between a tristimulus value of the white point and the correlated color temperature as the target correlation;

converting a plurality of sets of tristimulus values corresponding to all white points in the chromaticity diagram to a plurality of sets of RGB coefficients corresponding to the white points based on the target conversion matrix;

acquiring a plurality of correlated color temperatures corresponding to the white points according to the plurality of sets of tristimulus values and the target correlation; and performing curve fitting on the plurality of correlated color temperatures and the plurality of sets of RGB coefficients to obtain the relation curve.

5. The method according to claim 1, wherein:

the target RGB coefficients further comprise an R value conversion coefficient, a G value conversion coefficient, and a B value conversion coefficient, and converting the color in the screen to the target color corresponding to the target correlated color temperature further includes converting an R value, a G value, and a B value in RGB values corresponding to each of all colors currently displayed on the screen based on the target RGB coefficients to convert each color into a corresponding target color, the target color being a color corresponding to converted RGB values.

6. A non-transitory computer-readable storage medium having computer program instructions stored thereon, wherein when the computer program instructions are executed by a processor, the processor performs a screen color conversion method comprising:

determining a target correlated color temperature corresponding to an adjustment operation for a correlated color temperature of a color in a screen;

determining a relation curve reflecting a relation between RGB coefficients and the correlated color temperature according to a target correlation and a target conversion matrix, wherein the target conversion matrix is a conversion matrix between a tristimulus value of a white color displayable for the screen and the RGB coefficients, and the target correlation reflects a relation between the tristimulus value and the correlated color temperature determined according to a black body radiation locus;

determining target Red-Green-Blue (RGB) coefficients according to the relation curve and the target correlated color temperature; and converting the color in the screen to a target color corresponding to the target correlated color temperature according to the target RGB coefficients, wherein before determining the target correlated color temperature corresponding to the adjustment operation for the correlated color temperature of the color in the screen, the method further comprises:

determining the target conversion matrix according to a color gamut information of the screen and a preset color correction matrix, where the preset color correction matrix is a color adaptation matrix preset according to a human eye color adaptation mechanism, and avoiding color distortion when a color conversion is performed between a White color displayable on the screen and colors except for the white color; and determining the relation curve based on the target correlation and the target conversion matrix, wherein determining the target conversion matrix according to the color gamut information of the screen and the preset color correction matrix further comprises:

determining a first conversion matrix between the tristimulus value and the RGB coefficients according to the color gamut information, where the color gamut information includes a color coordinate of a standard red of the screen, a color coordinate of a standard green of the screen, a color coordinate of a standard blue of the screen, and a tristimulus value of a reference white of the screen; and modifying the first conversion matrix based on the color correction matrix to obtain the target conversion matrix.

7. An electronic device, comprising:

one or more processors; and a memory storing instructions executable by the one or more processors, wherein the one or more processors are configured to:

determine a target correlated color temperature corresponding to an adjustment operation for a correlated color temperature of a color in a screen;

determine a relation curve reflecting a relation between RGB coefficients and the correlated color temperature according to a target correlation and a target conversion matrix, wherein the target conversion matrix is a conversion matrix between a tristimulus value of a white color displayable for the screen and the RGB coefficients, and the target correlation reflects a relation between the tristimulus value and the correlated color temperature determined according to a black body radiation locus;

determine target Red-Green-Blue (RGB) coefficients according to the relation curve and the target correlated color temperature; and convert the color in the screen to a target color corresponding to the target correlated color temperature according to the target RGB coefficients, wherein the one or more processors are further configured to:

determine the target conversion matrix according to a color gamut information of the screen and a preset color correction matrix, where the preset color correction matrix is a color adaptation matrix preset according to a human eye color adaptation mechanism, and avoid color distortion when a color conversion is performed between a white color displayable on the screen and colors except for the white color; and determine the relation curve based on the target correlation and the target conversion matrix, wherein the one or more processors are further configured to:

determine a first conversion matrix between the tristimulus value and the RGB coefficients according to the color gamut information, where the color gamut information includes a color coordinate of a standard red of the screen, a color coordinate of a standard green of the screen, a color coordinate of a standard blue of the screen, and a tristimulus value of a reference white of the screen; and modify the first conversion matrix based on the color correction matrix to obtain the target conversion matrix.

8. The electronic device according to claim 7, wherein the adjustment operation further comprises an operation of adjusting at least one of:

the correlated color temperature when a blue light control mode of the screen is turned on, and a blue light control level of a blue light control mode by adjusting the correlated color temperature in the blue light control mode.

9. The electronic device according to claim 8, wherein the blue light control mode further comprises a preset number of blue light control levels, each blue light control level corresponding to one correlated color temperature, and the one or more processors are configured to determine the correlated color temperature corresponding to each blue light control level between a current blue light control level of the screen and a target blue light control level set in the adjustment operation as the target correlated color temperature.

10. The electronic device according to claim 7, wherein the white color displayable on the screen corresponds to a white point in the chromaticity diagram, and the one or more processors are further configured to:

determine, according to a black body radiation locus in the chromaticity diagram, a correlation between a tristimulus value of the white point and the correlated color temperature as the target correlation;

convert a plurality of sets of tristimulus values corresponding to all white points in the chromaticity diagram to a plurality of sets of RGB coefficients corresponding to the white points based on the target conversion matrix;

acquire a plurality of correlated color temperatures corresponding to the white points according to the plurality of sets of tristimulus values and the target correlation; and perform curve fitting on the plurality of correlated color temperatures and the plurality of sets of RGB coefficients to obtain the relation curve.

11. The device according to claim 7, wherein the target RGB coefficients comprise an R value conversion coefficient, a G value conversion coefficient, and a B value conversion coefficient, and the one or more processors are configured to convert an R value, a G value, and a B value in RGB values corresponding to each of all colors currently displayed on the screen based on the target RGB coefficients to convert each color into a corresponding target color, the target color being a color corresponding to the converted RGB values.

* * * * *